US008939758B2

(12) United States Patent
Kodali

(10) Patent No.: US 8,939,758 B2
(45) Date of Patent: Jan. 27, 2015

(54) CANDLES COMPRISING WAX-MONOESTERS

(75) Inventor: Dharma R. Kodali, Minneapolis, MN (US)

(73) Assignee: Global Agritech, Inc., Minneapolis, MN (US)

( * ) Notice: Subject to any disclaimer, the term of this patent is extended or adjusted under 35 U.S.C. 154(b) by 863 days.

(21) Appl. No.: 12/838,596

(22) Filed: Jul. 19, 2010

(65) Prior Publication Data

US 2012/0015312 A1 Jan. 19, 2012

(51) Int. Cl.
*F23D 3/16* (2006.01)
*C11C 5/00* (2006.01)

(52) U.S. Cl.
CPC ..... *C11C 5/002* (2013.01)
USPC ..... 431/288; 431/291; 431/298; 44/265; 44/275; 44/308

(58) Field of Classification Search
CPC ..... C11C 5/00; C11C 5/002
USPC ..... 431/288, 291; 44/265, 275, 308
See application file for complete search history.

(56) References Cited

U.S. PATENT DOCUMENTS 1,726,304 A * 8/1929 Lewis ..... 431/126
2,918,750 A * 12/1959 Blatt ..... 43/125
3,645,705 A * 2/1972 Miller et al. ..... 44/275
3,797,186 A * 3/1974 Smith ..... 52/314
3,844,706 A * 10/1974 Tsaras ..... 431/288
3,899,258 A * 8/1975 Matthews ..... 403/292
4,020,989 A * 5/1977 Kautz ..... 126/616
4,085,728 A * 4/1978 Tomchak ..... 126/669
4,103,059 A * 7/1978 Kautz ..... 428/178
4,170,220 A * 10/1979 Smith ..... 126/628
4,312,323 A * 1/1982 Domenech ..... 126/562
4,487,919 A * 12/1984 Trotter et al. ..... 528/272
4,507,077 A * 3/1985 Sapper ..... 431/288
4,714,496 A * 12/1987 Luken et al. ..... 106/270
4,759,709 A * 7/1988 Luken et al. ..... 431/288
5,411,782 A * 5/1995 Jarvis et al. ..... 428/57
6,054,517 A * 4/2000 Spaulding et al. ..... 524/275
6,199,340 B1 * 3/2001 Davis ..... 52/592.1
6,439,880 B1 * 8/2002 Ray ..... 431/288
6,503,077 B2 * 1/2003 Orth et al. ..... 431/288
6,517,343 B2 * 2/2003 Jones et al. ..... 431/288
6,534,573 B1 * 3/2003 Mace et al. ..... 524/277
6,537,335 B1 * 3/2003 Friars et al. ..... 44/275
7,160,337 B2 * 1/2007 Williams et al. ..... 44/275
7,462,205 B2 * 12/2008 Murphy ..... 44/275
7,588,607 B1 * 9/2009 Cap ..... 44/275
7,637,968 B2 * 12/2009 Murphy ..... 44/275
8,070,833 B2 * 12/2011 Murphy ..... 44/275
2002/0013444 A1 * 1/2002 Jones et al. ..... 528/170
2002/0019510 A1 * 2/2002 Orth et al. ..... 528/335
2002/0032982 A1 * 3/2002 Berger et al. ..... 44/519
2003/0024152 A1 * 2/2003 Berger et al. ..... 44/275
2003/0110682 A1 * 6/2003 Williams et al. ..... 44/275
2003/0126788 A1 * 7/2003 Uang et al. ..... 44/275
2003/0213163 A1 * 11/2003 Berger et al. ..... 44/275
2006/0236593 A1 * 10/2006 Cap ..... 44/275
2007/0006521 A1 * 1/2007 Licciardello et al. ..... 44/275
2007/0094917 A1 * 5/2007 Burkhamer et al. ..... 44/275
2010/0044924 A1 * 2/2010 Cap ..... 264/489
2010/0196424 A1 * 8/2010 Kodali ..... 424/400

FOREIGN PATENT DOCUMENTS

WO 2009/018144 A 2/2009

* cited by examiner

*Primary Examiner* — Jorge Pereiro
(74) *Attorney, Agent, or Firm* — Gary C Cohn PLLC

(57) ABSTRACT

Candle compositions are disclosed which include a high concentration of liquid oils, yet are solid due the incorporation of wax-monoesters; thereby enhancing the scope, quality and functionality of candles. The wax-monoesters may be obtained from natural plant based waxes, including rice bran wax. Candles based on the candle compositions and methods of making the compositions are also disclosed.

6 Claims, No Drawings

CANDLES COMPRISING WAX-MONOESTERS

This application claims priority from U.S. Provisional Application 61/222,774, filed 22 Jul. 2009.

BACKGROUND

Candles are used universally as a source of light and for pleasant ambience in regular life and at special occasions. A typical candle is made from combustible fuel material that provides structure and stability and contains a wick in the middle. Lighting of the candle ignites the combustible material on the wick which generates heat to melt the solid surrounding the wick, further forming a liquid pool that can flow into the wick by capillary action and burn until all the fuel is consumed. The candle can be used multiple times or all at once.

Candles are made with various raw materials including natural and synthetic materials. The customary base raw materials that are used in candle manufacturing are paraffin wax, bees wax, hardened (hydrogenated) fatty acids (aka stearin), animal waxes like tallow, and hardened fats, oils (hydrogenated fats, aka hydrogenated triacylglycerols or triglycerides). Currently the use of paraffin waxes is most prevalently used due to cost, availability, and different grades of waxes with different melting profiles and physical properties. In addition to the base material, the candle may contain perfumes for aroma, coloring dyes, antioxidants, insect repellents, or other additives to improve the mechanical properties and burning characteristics.

Candle formulations typically contain substantial amounts high melting temperature materials. These materials are liquefied (melted) and processed into candles by adopting various methods that include pouring, molding, dipping, casting, drawing, extrusion or rolling processes. General purpose candles are usually made by molding or pouring processes. Standard commercial candles usually contain 50 to 80 percent petroleum wax, 10 to 35 percent stearic acid (hydrogenated fatty acids), and 0 to 10 percent stabilizers, 0 to 3 percent color and 0 to 10 percent fragrance. Some candles may contain small amounts of candelilla or carnauba waxes to regulate the softening or melting point of the finished wax. Beeswax candles are made of only pure insect wax and paraffin plus a small amount of stiffening wax.

The wick is commonly made of a high grade cotton or linen. The material is woven (or braided) and treated with inorganic materials so that it will burn in one direction and will curl so that its end remains in the candle flame's oxidizing zone for even and intense burning. Often, wire-core wicks are also used. These wicks have a wire center that allows them to burn slightly hotter than cotton and remain erect in the melted wax.

Candles made with petroleum based waxes produce smoke, soot and unpleasant odor due to the presence of branched hydrocarbons, aromatic compounds and sulfur compounds. The soot particles and smoke pose health risk to humans especially when used in closed environments. Also the petroleum raw materials are non renewable, not environmentally friendly and not considered "green".

The use of partially hydrogenated vegetable oils (triacylglycerols), aka vegetable waxes or fats in candles is advantageous as they are derived from renewable materials. The melting profile of vegetable oils and their suitability to use in candles depends upon the type of oil and unsaturation content and the degree of hydrogenation. However, the hydrogenation process adds significant cost to the material due to the need for a pressure reactor and a metal catalyst. Additionally, transportation, material transfers of solid fats is cumbersome and expensive. Also the use of partially hydrogenated vegetable oils in candles is further complicated by polymorphism, which is the ability to crystallize into different crystal forms that have different melting temperatures and other physical properties. Candles made with predominantly hydrogenated vegetable oils show a white chalky appearance, cracks and specks with time. Most of these defects are a manifestation of polymorphism. The additional disadvantages of using partially hydrogenated vegetable oils include: high volume change or shrinkage during the liquid to solid transition, air pocket formation, textural changes with time, and problems in use such as guttering or brake-outs.

One approach to overcome the disadvantages of using partially hydrogenated vegetable oils involves the use of substantial amounts of liquid oils in the fabrication of a candle. This has number of advantages, including cost and the low volume change or shrinkage while undergoing liquid to solid transition during the manufacturing. Further, the liquid oils (especially polar oils like vegetable oil) have the ability to incorporate higher amounts and uniform distribution of fragrance and coloring materials into the candle, a much desired feature. The use of liquid oils in candles has been reported in the prior art. Wilson S. K. (publication No.: US 20020069580) reported gelled hydrocarbon compositions which were gelled by using low and medium molecular weight triblock polymers. Shinski R. J. (publication No.: US 20030101639) describes a gel candle assembly comprising a gel candle made of three different viscosity mineral oils and a polymer to produce a self supporting structure. Tao et al. (publication No.: US 20040200136) describe a candle composition comprising fatty acid, plant oil and a crystal modifier. Recently Wu et al. (publication No.: US 20080307696) described a candle composition having paraffin, non-hydrogenated oil, and a solidifying amount of congealing reagent comprising petrolatum, oxidized petrolatum, oxidized long chain hydrocarbons, or modified hydrocarbons. These approaches produce functional candles with moderate incorporation of liquid oils, however, there remains a need for improved candle compositions, especially compositions containing natural and renewable materials, to produce high quality candles which incorporate large percentages of liquid oils and/or lower melting, partially hydrogenated vegetable oils.

SUMMARY

The present invention provides a simple and cost effective means to incorporate high percentages of liquid oil in a solid candle composition, via the inclusion of wax-monoesters, thereby enhancing the scope and functionality of candles. Wax-monoesters are long chain fatty acids esterified to a long chain fatty alcohol. When the wax-monoester is homogenized with liquid oils at high temperatures and cooled, the crystal matrix of wax-monoesters that is formed entraps the liquid oils and transforms into a solid body. This is particularly effective when the wax-monoester forms long thin (needle-like) crystals.

Wax-monoesters can be readily obtained from natural and renewable raw material, such as rice bran wax.

The candles of this invention are environmentally friendly and may contain 100% natural and renewable materials. Also the candles of this invention may comprise up to >99% liquid component which can be vegetable oil or any other liquid fuel and additives.

The present invention provides a method of making free-standing and container candles containing wax-monoesters from 0.5% to 30% and the remaining portion of the candle body containing base-fuel and additives. The base-fuel and additives also can be completely natural and renewable material or partially renewable material or completely non-renewable materials. Additionally the base-fuel and additives can be 100% liquids or contain at least 70% liquid components at room temperature.

Various other features and advantages of the present invention should become readily apparent with reference to the following detailed description, examples, and claims. In several places throughout the specification, guidance is provided through lists of examples. In each instance, the recited list serves only as a representative group and should not be interpreted as an exclusive list.

DETAILED DESCRIPTION OF ILLUSTRATIVE EMBODIMENTS OF THE INVENTION

The invention relates to compositions used in the production of candles ("candle compositions"), methods of manufacturing the candle compositions, and candles containing the candle compositions. According to this invention the candle compositions can be further divided into base-fuel, wax-monoesters, and other additives. Here, "base-fuel" refers to combustible materials that constitute the major fraction of the candle composition. Wax-monoesters will be further described below. "Other additives" refer to other materials commonly added to candle compositions. Other additive include: fragrance oils, dyes, stabilizers, antioxidants, insect repellants, air fresheners, fillers, etc. The term "base-compound" refers to the compounded mixture of base-fuel and wax-monoesters.

Generally, there are two types of waxes: hydrocarbon waxes and wax esters. Hydrocarbon waxes are typically petroleum-derived hydrocarbon chains of linear, branched or cyclic structures without any functional group, although some hydrocarbon waxes have natural biological sources. Wax esters are typically plant-derived or animal-derived esters. The wax esters can be monoesters or polyolesters. The polyol esters are esterified hydroxyl compounds that contain more than one hydroxyl group. For example polyols containing two hydroxyl groups, such as ethylene glycol, three hydroxyl groups, such as glycerol, four hydroxyl groups, such as pentaerythritol and others. The polyol esters may contain one or more ester functionality but are not included in the wax-monoesters of this invention. The wax-monoesters of this invention are specifically linear esters of long chain fatty acids and long chain fatty alcohols of total carbon chain length of 40 carbon atoms or greater. The long chain fatty acids and fatty alcohols of wax-monoesters of this invention contain a single functional group at the end of the hydrocarbon chain, either a carboxylic acid or a hydroxyl function and are connected by an ester linkage. The terms "wax-monoester" and "wax-monoesters" are interchangeable, representing either individual compounds or mixture of compounds.

Candle compositions of this invention contain a mixture containing, by weight of the mixture, 70 to 99.5% base-fuel and 0.5 to 30% wax-monoesters. Optionally the candle composition may also contain 0.1% up to 20%, based on the total weight of the candle composition, of other additives. The suitable base-fuels are any of the plant derived triacylglycerol oils or fats, petroleum derived hydrocarbon oils or waxes, saturated or unsaturated fatty acids or their ester derivatives or mixtures of one or more of these compositions which have a liquid component of greater than 70% at room temperature. By this we mean that at least 70% of the total weight of the base-fuel is made up of components that individually melt at or below 25° C. These base fuels can be completely liquid at room temperature or semisolids that can flow.

The wax-monoesters of this invention are linear wax esters of fatty acid (carbon chain lengths from C16 to C32) and fatty alcohol (carbon chain lengths C24 to C38) having a minimum carbon chain length of 40 carbon atoms or greater. Wax-monoesters that are suitable for this application have a melting point of at least >70° C. (158° F.) or even >75° C. (167° F.). These melting temperatures are for neat wax-monoesters. However, when the wax-monoesters compounded with liquid oils to form candles the observed melting temperatures of the compositions will get lowered, as a function of concentration, as indicated by gel-flow temperatures given in Table-5. The wax-monoester molecular weights range from 600 Daltons to 1000 Daltons. Wax-monoesters may be supplied and used in the form of plant derived natural waxes. Some of the plant derived natural waxes that contain wax-monoesters among others are rice bran wax, carnauba wax and candelilla wax. Rice bran wax is composed almost entirely of wax-monoesters. The fatty acids and fatty alcohols and their weight percent is shown in Table 1.

TABLE 1

| Carbon Number | Fatty Acid Wt. % | Fatty Alcohol Wt. % |
|---|---|---|
| 16 | 3.6 | — |
| 18 | 2.3 | — |
| 20 | 5.3 | — |
| 22 | 26.1 | — |
| 24 | 40.5 | 3.5 |
| 26 | 11.5 | 8.4 |
| 28 | 6.6 | 14.0 |
| 30 | 3.1 | 26.4 |
| 32 | 1.0 | 19.6 |
| 34 | — | 16.5 |
| 36 | — | 9.2 |
| 38 | — | 2.4 |

In contrast, the composition of carnauba wax contains fatty acid esters (80-85%), free alcohols (10-15%), acids (3-6%) and hydrocarbons (1-3%). As a peculiarity, carnauba wax contains esterified fatty dialcohols (diols, about 20%), hydroxylated fatty acids (about 6%) and cinnamic acid and its derivatives (about 10%) (Letcher, C. S. Waxes. Kirk-Othmer Encycl. Chem. Technol., 3rd Ed. (1983), 24, 466-81). The chemical composition of candelilla wax is mainly hydrocarbons (n-alkanes), 50-55% with C31, hentriacontane as major component. In addition to that, it contains esters of fatty acids with carbon numbers varying from 16 to 34, and fatty alcohols with carbon numbers varying from 22 to 34 with free fatty acids and free fatty alcohols (Morales-Rueda J A, Dibilox-Alvarado, Charó-Alonso M, Weiss R G, Toro-Vazquez J F., Thermo-mechanical Properties of Candelilla Wax and Dotriacontane Organogels in Safflower Oil, Eur J Lipid Sci Technol (2009), 111: 207-215). Of these waxes the rice bran wax, is typically more effective than other waxes in embodiments of this invention.

Suitable wax-monoesters of this invention can be of natural or synthetic origin. It is expected that synthetic wax-monoesters of greater purity with carbon chain lengths greater than 40 may provide solidification properties better than RBX. Suitable wax-monoesters can include a major fatty acid chain length of at least 14 carbons to no more than 36 carbons. Thus, in certain embodiments, a suitable wax-monoester can include a major fatty acid chain length of at least 18 carbons, at least 22 carbons, at least 24 carbons, or at least 26 carbons. Also, in certain embodiments, suitable wax-monoesters can include a major fatty acid chain length of no more than 32 carbons, no more than 26 carbons, or no more than 24 carbons. Suitable wax-monoesters can include a major fatty alcohol length of at least 20 carbons. Thus, in certain embodiments, a suitable wax-monoester can include a major fatty alcohol length of at least 24 carbons, at least 28 carbons, at least 30 carbons, or at least 32 carbons. Also, in certain embodiments, a suitable wax-monoester can include a major fatty alcohol length of no more than 38 carbons, of no more than 34 carbons, no more than 32 carbons, or no more than 30 carbons.

Suitable wax-monoesters can have a melting point of at least 70° C. and no more than 90° C. as measured neat. Thus, in certain embodiments, a suitable wax ester can have a melting point of, for example, at least 70° C., or at least 75° C. Also, in certain embodiments, a suitable wax-monoester can have a melting point of, for example, no more than 85° C., no more than 83° C., or no more than 81° C.

In some embodiments, the composition can include wax-monoester in an amount of at least 0.5% and no more than 30% of the composition, by weight. Thus, in certain embodiments, the composition can include wax in an amount of at least 0.5%, at least 1%, or at least 2% of the composition, by weight. Also, in certain embodiments, the composition can include wax-monoester in an amount of more than 2%, no more than 15%, or no more than 25%, by weight.

In certain embodiments, the source of wax-monoester can include rice bran wax. Rice bran wax is a natural wax derived from rice bran produced from milling rice (*Oriza sativa*). Most rice varieties are composed of roughly 20% rice husk, and the remaining bran layers, and starchy endosperm. In certain rice milling processes, the husk is removed in a first step, yielding brown rice. Brown rice may be further processed to remove the bran, yielding the bran and refined grains of white rice. The primary constituents of rice bran are protein, fiber, and oil.

Rice bran contains about 20 wt % oil, which can be extracted with an organic solvent such as, for example, hexane. Along with the oil, other substances that may be extracted from rice bran include, for example, free fatty acids, partial glycerol esters, phospholipids, wax esters and other unsaponifiable materials, such as, for example, certain antioxidants (e.g., tocopherol, oryzanol, and tocotrienol), and squalene. Rice bran oil contains a plurality of components such as, for example, rice bran wax, antioxidants, and sterols. The concentration of rice bran wax in the oil typically ranges from 1% to 3%.

Rice bran wax is a high melting solid that settles from the rice bran oil upon cooling. Rice bran wax is separated by filtration and refined by bleaching and deodorization. Refined rice bran wax also may contain small amounts of free fatty acids and/or antioxidants such as, for example, oryzanol and tocopherols. The primary components of rice bran wax are long chain fatty acids esterified to very long chain fatty alcohols. (Vali et al., A process for the preparation of food grade rice bran wax and the determination of its composition, JAOCS, (2005) 82, 57-64).

A typical rice bran wax ester structure can include any of the fatty acids shown in Table 1 (e.g., C16-C32) esterified to any of the fatty alcohols shown in Table 1 (e.g., C24-C38). Thus, for example, typical rice bran wax ester structure can include a total carbon chain length of about 40 carbons or more (e.g., a C16 fatty acid ester of a C24 fatty alcohol) up to and including about 70 carbons (e.g., a C32 fatty acid ester of a C38 fatty alcohol). In one particular embodiment, a typical rice bran wax ester structure includes lignoceric acid (C24 fatty acid) ester of tricontanol (C30 fatty alcohol)—i.e., a total carbon chain length of 54 carbon atoms, having a molecular formula of C54H108O2 and a molecular weight of 788 as shown below.

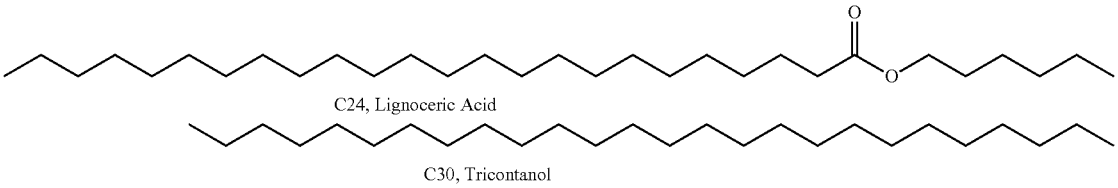

Molecular formula=$C_{54}H_{108}O_2$; Molecular weight=788

The powder x-ray diffraction of rice bran wax in bulk revealed long spicing with weak intensity corresponding to 70 Å. The long spacing roughly corresponds to the typical wax ester structure of lignoceric acid (C24) esterified to C30 alcohol, tricontanol. The straight 52 carbon chain distance corresponds to 66 Å and the ester function with two carbons occupies about 4 to 5 Å. The wide angle region showed an orthorhombic subcell structure with characteristic short spacings of 4.14 and 3.74 Å. The bulk x-ray diffraction data confirms the wax-monoesters of fatty acids and fatty alcohols of average total carbon chain length of 54.

Rice bran wax is natural hard wax with a high melting point. The molecular structure of rice bran wax facilitates packing in the solid state to form a hard high melting wax. The thermal behavior of rice bran wax as observed in differential scanning calorimeter, the heating scan shows a single endothermic peak (melting) at 80° C. with an enthalpy of melting of 197.9 J/g, and the cooling scan shows an exothermic peak (crystallization) at 76° C. When the rice bran wax is dissolved in hydrophobic liquids, such as vegetable oils or alkyl fatty acid esters and cooled, the wax-monoester molecules readily solidify into a thin crystalline mesh that entraps a large volume of liquid. Such solid compositions are also referred to as gels or organogels.

Rice bran wax can be useful for changing the rheology of a formulation when incorporated at relatively low concentration compared with other natural waxes. In candle preparation RBX facilitates the incorporation of liquids which have lower viscosity, for example triacylglycrol oils or fatty acid methyl esters. Rice bran wax can act as a moisture barrier, and can add gloss and/or luster to surfaces to which it is applied, which can be desirable in many food and cosmetic applications. In manufacturing, rice bran wax can provide friction modification and gloss enhancing properties, which can be useful in certain pharmaceutical applications such as, for example, tablet panning and coating. Also, plasticizing and mold release properties of rice bran wax can make it useful in various applications.

Carnauba wax (CRX) is derived from leaves of carnauba palm (*Copernicia prunifera*), native to northeastern Brazil.

Carnauba wax contains mainly esters of fatty acids and fatty alcohols and minor amounts of hydrocarbons, hydroxy fatty acids, and cinnamic acid derivatives. It has a melting point of 81° C., which is comparable to rice bran wax. The thermal behavior of carnauba wax as observed in differential scanning calorimeter, the heating scan shows a multiple endotherms with a peak at 81° C. with an enthalpy of melting of 137.7 J/g, and the cooling scan shows multiple exotherms with peak at 77° C.

Candelilla wax (CLX) is derived from the leaves of a small shrub (*Euphorbia cerifera* and *Euphorbia antisyphilitica*), native to northern Mexico and southwestern USA. Candelilla wax contains mainly hydrocarbons (n-alkanes), wax esters of fatty acids and fatty alcohols, fatty alcohols, sterols and free fatty acids. The thermal behavior of candelilla wax as observed in differential scanning calorimeter, the heating scan shows multiple endotherms with a peak at 70° C. with an enthalpy of melting of 129 J/g, and the cooling scan shows multiple exotherms with peak at 63° C.

Both carnauba and rice bran wax are high melting hard waxes and used in certain similar applications. However in candle applications the carnauba wax and candelilla wax do not typically perform as well as rice bran wax. This might be due to the observed spherulitic crystal morphology of carnauba wax and candelilla wax in the liquid oils. In contrast, RBX forms a long thin thread like crystals that are more conducive to form a crystal matrix with better ability to entrap liquids. Further, standard commercial preparations of carnuba wax and candelilla wax typically have much lower concentrations of wax-monoesters, than rice bran wax. Comparatively, RBX can be more cost effective than carnauba wax or candelilla wax.

In certain embodiments, the wax monoester can be extracted from a natural source and, therefore, may contain certain amounts of antioxidants such as, for example, tocopherol, tocotrienol, oryzanol, or any combination thereof. Optionally the candles may contain natural or synthetic antioxidants that are added to the formulation.

Generally, the composition may be formed by mixing non-hydrogenated oil or partially hydrogenated oil or fat, and wax-monoester with heating and agitation; and allowing the mixture to cool. The cooling step is done with no stirring or agitation to allow the formation of crystal matrix. In some embodiments, the wax-monoester may be melted prior to mixing with the oil. In other embodiments, the wax-monoester and the oil may be combined prior to heating and homogenizing.

In certain embodiments, the method can further include melted wax-monoester/oil mixture and additives. In other embodiments, the method can further include homogenizing the melted wax/oil mixture containing stabilizers, dyes and fragrant oils.

The candles made with the present technology can be dip coated with a higher melting wax composition for greater stability. The dip coating or immersion coating is important for free-standing candles as it can have different layers of coating with different compositions. This can be generally achieved by making a solidified candle composition containing the wick and cooling the candle below room temperature and immersing the cold candle in a different candle composition. If desired this can be repeated. Similarly in the case of container candles to achieve harder surface or mechanical strength the once candle composition is cooled below the room temperature and then overlaid with a layer of candle composition containing higher wax-monoester concentration. Some oils such as vegetable oils have higher ability to bind to fragrance and dyes due to their higher polarity compared to paraffin oils, and these polar oils help to increase the loading of fragrances and dyes. In this way the inside composition can have higher fragrance loading than the outside thus reducing the loss of fragrance and better release during the use.

In candle manufacturing, the origin, chemical composition, properties and prices of the base-fuels differ from each other considerably. So the ability to choose one or more of the base-fuels will provide advantages in cost and functional properties. This invention facilitates the use of liquid oils of different origin and properties, thus enabling the candle manufacturer to choose most effective formulations based on the cost and performance.

Candles of this invention can be container candles or free-standing candles. Candles of different compositions of this invention can be made in a conventional manner. The candles contain a body portion and one or more wicks. Depending on the application requirements and aesthetics the body of the candle can be in various shapes, sizes and colors.

Burn testing of the candles containing wax-monoesters reveals that the burn characteristics such as burn rate, melt pool diameter can be modified with the wax-monoester content. When the candle is lit, the temperature gradient around the flame decreases with distance from the center. The temperature gradient and the melting profile of the composition contribute to the pool diameter. The melt pool diameter influences the burn rate of the candle. When the pool diameter approaches the edge guttering and dripping occurs. By carefully formulating with right concentration of wax-monoester guttering and dripping can be eliminated.

The candles of this invention are made with wax-monoesters and emit less smoke and no soot or odor. The soot formation increases with branched chain hydrocarbons or iso-paraffins. They also decrease the flame temperature. The candles made with petroleum based oils and waxes produce more smoke, soot and unpleasant odor due to the presence of branched hydrocarbons, aromatic compounds and sulfur compounds. Candles made with triacylglycerol based vegetable oils and fats emit less soot or smoke and do not have any undesirable odor.

According to this invention, the candles made with wax-monoesters exhibit high heat distortion stability. This improved thermal stability is due to higher melting temperature and the absence of softening point as evident from the thermal behavior of RBX differential scanning calorimeter melting behavior. Optionally the mechanical strength of the candles can be increased by adding partial glycerol esters (mono- or di-acylglycerols), free fatty acids, organoclays among others.

The high liquid content and polarity of the candle facilitates the higher loading of fragrance oil and coloring matter and their uniform distribution. Generally, but not bound by the explanation, liquid vegetable oils are more polar than hydrocarbon oils due to the ester functionality. The coloring dyes and fragrance oils have higher solubility in vegetable oils. Also as seen from the X-ray diffraction pattern from the solidified vegetable oil rice bran wax organogel the wax-monoester crystals and liquid vegetable oil co-exist. This indicates that the scaffolding of wax-monoester crystal matrix holds the liquid oil and provides the mechanical strength and rigidity to the candle body. The compartmentalization created by the crystal matrix will decrease the vapor pressure of the fragrance oil, which are usually volatile material, and thereby reducing the loss of fragrance during the shipping and storage. The same crystal matrix of RBX will help the controlled release of the fragrance when melt at the flame of the burning candle.

The candles of this invention will have very low volume (or dimensional) change as they undergo liquid to solid transformation. This is due to the presence of high liquid content in the solid crystal matrix of wax-monoester. Also the wax-monoesters exhibit very low volume change during the phase change compared to fats. The small mass of wax-monoester content of the candle that undergoes the phase change from liquid to solid, and its inherent low volume change between the phases, results in low shrinkage during the candle processing.

Blooming and white chalky appearance is a problem that the candles exhibit with time. It is known that the solid triacylglycerols undergo polymorphic transformation from one crystal form to another more stable crystal form resulting in blooming and chalky appearance. The candles of this invention are smooth and do not exhibit blooming or white chalky appearance.

The processing time of the candles of this invention, generally is reduced compared to the standard candles containing high solids. As seen from the thermal behavior of the wax-monoesters due to their linear molecular geometry, the crystallization occurs at temperatures very close to the melting temperatures. The delta T values (the temperature difference from melting to crystallization) of wax-monoesters are in the range of 4° C. to 7° C. compared to triacylglycerol based fats or oils which are usually in the range of 25° C. to 35° C. The quick crystallization as observed from the induction times for crystallization and the smaller mass of wax-monoesters in the candle formulation facilitates the reduction in setting time.

According to the present invention candles can be made with 100% natural and renewable raw materials. The following formulations illustrate such materials. Candles containing substantially liquids >90% at room temperature can also be prepared as shown in the following examples and in Table 3 and Table 4. This technology facilitates making free standing candles containing liquids at 80% and even as much as 90%.

According to this invention the base-fuel is 70% to 100% liquid at 25° C. The base-fuel can be triacylglycerol oils such as soybean oil, canola oil, sunflower oil, palm oil, corn oil and other plant oils, or petroleum derived hydrocarbon oils or animal derived tallow or whale sperm oil etc. and the mixtures thereof. These oils can be partially hydrogenated. The base-compound may contain 70 to 99.5% of base-fuel and 0.5% to 30% wax-monoester. In a typical base-compound preparation, proper concentrations of base-fuel and wax-monoester are mixed and heated to 90° C. with agitation until all the contents are completely melted and homogenized. Optionally, to this base-compound other additives such as fragrance oils, dyes, stabilizers, antioxidants, insect repellants, air freshners are added and homogenized at 80° C. This homogeneous liquid composition is ready to be made into candles by any of the standard candle manufacturing methods described above.

The embodiments of this invention can solve number of quality problems and improves the performance of free standing and container candles, including: improved shipping stability, increased heat distortion stability, increased content of natural and renewable materials, decreased soot and smoke, high fragrance loading capacity, low fragrance loss with time and controlled release, high loading of coloring matter and uniformity, quick curing (lower processing times), no thermal shock during cooling, no cracking, prevents blooming and eliminates white chalky marks, decreased shrinkage during processing, better mold release, smoother and shiny surface, controlled melt pool and burn rate (which prevents break-outs, guttering, dripping or spilling), and synergistic properties with other structural agents such as partial glycerol esters (mono- and di-acylglycerols), free fatty acids, orgnoclays and others.

EXAMPLES

The following examples have been selected merely to further illustrate features, advantages, and other details of the invention. It is to be expressly understood, however, that while the examples serve this purpose, the particular materials and amounts used as well as other conditions and details are not to be construed in a matter that would unduly limit the scope of this invention.

Materials and Methods:

Olive oil, canola oil, sunflower oil and salad oil (a blend of canola oil and soybean oil 50/50), are refined edible oils obtained from a grocery store. Liquid paraffin is obtained from Wacko Chemicals (Japan). The mineral oil containing tocopheryl acetate and fragrance is bought in retail store as baby oil manufactured by Faveur. Carnauba wax and candelilla wax are obtained from Lambent Technologies (Gurnee, Ill.). Rice bran wax is obtained from Global Agritech, Inc. (Minneapolis, Minn.). The typical properties of rice bran wax used in the following Examples are shown in Table 2. The typical analysis given in the table is a snap shot of analysis results of a sample and the expected variation of each property is shown as range.

TABLE 2

| Property | Typical Analysis | Range |
|---|---|---|
| Melt Point (° C.) | 80 | 78-80 |
| Acid Value (mg KOH/g) | 4 | 2-8 |
| Iodine Value | 6 | 5-15 |
| Saponification Value (mg KOH/g) | 85.0 | 78-90 |
| Penetration Depth (25° C., dmm) | 4 | 3-5 |
| Color (Gardner Scale) | 5 | 5-10 |

Carnauba wax is supplied by Lambent Technologies (Gurnee, Ill.).

The thermal behavior of the waxes were determined by differential scanning calorimeter (DSC) using the Rigaku DSC-8240 calorimeter. An Olympus BX-50 equipped with an Olympus PM-20 camera was used for microscopic observations. The crystal morphology observations were made with cross polarized light. The x-ray diffraction pattern was measured using a Rigaku X-ray diffractometer (40 kv, 10 mA) with Cu—Kα radiation.

Example 1

Crystallization behavior of rice bran wax (RBX), carnauba wax (CRX), and candelilla wax (CLX) in liquid olive oil at different concentrations were tested. Induction times for crystallization were determined by preparing the oil, wax mixtures, heating the mixture, and allowing the mixture to cool. The olive oil/wax mixtures were prepared by the addition of appropriate amounts of solid wax to 15 grams of olive oil in 2.5 cm diameter test tubes. Each oil/wax mixture was heated to 80° C. in a water bath with shaking to dissolve the wax in the liquid oil. The resulting homogeneous solutions were left at room temperature (at 20° C.) to cool. The olive oil/wax solutions were observed without disturbing until the appearance of crystals. The times taken for various concentrations of rice bran wax, carnauba wax and candelilla wax for first crystal appearance are taken as induction time for crystallization and are shown in Table 3.

TABLE 3

| | Wax Concentration (%) | | | | |
|---|---|---|---|---|---|
| | 4 | 2 | 1 | 0.5 | 0.2 |
| RBX (minutes:seconds) | 0:34 | 1:03 | 1:38 | 2:40 | 6:07 |
| CRX (minutes:seconds) | 0:35 | 1:03 | 1:26 | 2:05 | 4:47 |
| CLX (minutes:seconds) | 2:41 | 4:43 | 7:42 | * | * |

* No crystals observed in two days.

Thus, the crystallization of wax-monoesters in liquid oil occurs very quickly. In the case of rice bran wax and carnauba wax the crystals appear at very low wax concentrations of 0.2 wt %. In the case of candelilla wax 1 wt % wax concentration is necessary to observe the crystals.

Example 2

The solidification or gelation times of oil/wax mixtures were determined in a similar manner. The olive oil/wax mixtures were prepared as described in Example 1. The homogenous oil/wax solutions were left at 20° C. for gelation. The solidification time in minutes were measured as the time necessary for the oil to stop flowing, upon tilting the sample to 45°. The solidification times for rice bran wax (RBX), carnauba wax (CRX) and candelilla wax (CLX) are shown in Table 4.

TABLE 4

| | Wax Concentration (%) | | | | |
|---|---|---|---|---|---|
| | 4 | 2 | 1 | 0.5 | 0.2 |
| RBX (minutes:seconds) | 4:42 | 6:24 | 7:16 | 10:45 | * |
| CRX (minutes:seconds) | 13:45 | * | * | * | * |
| CLX (minutes:seconds) | 9:20 | 13.45 | * | * | * |

* No solidification was observed in two days.

Rice bran wax is a very effective solidification agent even at low concentrations of 0.5 wt %. This is due to the rice bran wax composition, almost entirely containing wax-monoesters. In the case of carnauba wax a somewhat greater (4 wt %) wax concentration is necessary to effect the solidification, whereas for candelilla wax a 2 wt % concentration of wax is necessary.

Example 3

Oil/wax mixtures of rice bran wax (RBX), carnauba wax (CRX) and candelilla wax were prepared by adding the appropriate amounts of solid wax to 15 grams of olive oil. The olive oil wax mixture is heated to 80° C. in a water bath with agitation to dissolve the wax in the liquid. The resulting homogeneous solutions are left at room temperature (at 20° C.) to cool and form gel. The gels were left at room temperature for two to three hours. The gelled samples were heated in a water bath from 20° C. to 70° C. at 3° C./minute. The temperature at which flow is observed upon tilting the sample to 45° is taken as gel-flow temperatures and are shown in Table 5.

TABLE 5

| | Wax Concentration (%) | | |
|---|---|---|---|
| | 4 | 2 | 1 |
| RBX (° C.) | 64.8 | 59.8 | 57.9 |
| CRX (° C.) | 59.1 | * | * |
| CLX (° C.) | 63.2 | 52.0 | * |

* No gelation.

Example 4

This example contains a container candle having 100% natural and renewable materials containing >90% liquid oil at room temperature. A candle base-fuel made up of canola oil 47 grams is mixed with 3 grams of rice bran wax, heated to 85° C. and agitated to form a homogenous mixture. While the contents are at or above 75° C. are poured into a container having a wick. The candle upon cooling sets to a solid body in about 20 minutes. The candle when lit burnt clean without any soot or smoke and no odor.

Example 5

This example shows a container candle made with 100% natural and renewable materials containing >95% liquid oil at room temperature. A candle base-fuel made up of canola oil 48.5 grams is mixed with 1.5 grams of rice bran wax, heated to 85° C. and agitated to form a homogenous mixture. While the contents are at about 75° C. are poured into a container having a wick. The candle upon cooling sets to a solid with in 30 minutes.

Example 6

This example contains a container candle having 100% natural and renewable materials containing >85% liquid oil at room temperature. A candle base-fuel made up of canola oil 45 grams is mixed with 5 grams of rice bran wax, heated to 85° C. and agitated to form a homogenous mixture. While the contents are hot and at about 75° C., are poured into a mold having a wick. The candle upon cooling sets into a solid body in about 15 minutes.

The examples 7, 8 and 9 were conducted with 13% of wax in sunflower oil by following this protocol. Sun flower oil 14 grams and 2.1 grams of one of the three waxes, rice bran wax or carnauba wax or candelilla wax were added and mixed in a steel container. The contents were heated to 88° C., stirred to form homogenous oil. About 12 grams of this homogenous oil mixture while hot at about 75° C., is poured into tea lights metal container containing a wick and left at room temperature (about 25° C.) to settle.

Example 7

This example is prepared as described above, contained 13% of rice bran wax in sunflower oil. The sunflower oil/wax in the tea lights candle set into solid in about 11 minutes. The surface of the candle is smooth and is not sticky or oily. After 20 minutes the surface is tested for hardness by pushing with a finger. The surface is hard and did not leave any finger prints.

Example 8

This example is prepared as described above, contained 13% of carnauba wax in sunflower oil. The sunflower oil/wax in the tea lights candle set into solid in about 21 minutes. The surface of the candle is sweated with oil (beads of very small oil droplets), glistening and sticky.

Example 9

This example is prepared as described above, contained 13% of candelilla wax in sunflower oil. The sunflower oil/wax in the tea lights candle set into solid in about 23 minutes. The surface of the candle is very smooth but oily.

Example 10

Sunflower oil 41 grams is mixed with rice bran wax 9 grams (18% rice bran wax) and heated to 90° C. while stirring. A portion of the homogenous oil/wax mixture while hot and a clear is poured into a plastic tube mold containing a wick in the center. The plastic mold after setting into a solid in about half an hour is removed and further cooled in a freezer set at −5° C. for another half hour. The stand alone candle is removed from the mold easily. The candle burned clean with a uniform melt pool without any odor or smoke. The other part of the homogenous oil/wax mixture while hot and clear is poured into a glass container having a wick in the middle and allowed to solidify at room temperature. The votive candle in the glass container is left in a freezer for 30 minutes. The votive candle in the glass container does not show any shrinkage (no observable gap between the candle and the container) but released easily from the glass container. The candle is hard with a smooth surface with out any stickiness.

Example 11

This example provides a layered candle containing different concentrations of wax. A tea lights candle with canola oil containing 6% rice bran wax is prepared similar to Example-4. The tea lights candle is filled into the container up to three fourth of the volume with this composition. Upon cooling it settled into a solid candle. The candle is solid but not very hard. The candle is further cooled in a freezer for 15 minutes. About two grams of hot homogenous sunflower oil containing 10% rice bran wax at 75° C. is poured on the top of the cold candle. The newly poured liquid in about two minutes solidified on the top of the candle forming a new harder surface. The top layer having higher concentration of rice bran wax provided firmer surface with better structural stability.

Example 12

This example explains the manufacturing of encased candles. Canola oil 112.5 grams and rice bran wax 37.5 grams (25% RBX concentration) are mixed, heated and homogenized by heating to 90° C. This homogenous oil wax mixture is kept between 70-80° C. The votive and stand alone candles containing 18% rice bran wax prepared similar to the procedure described in example 10 were cooled to 5° C. in a freezer. The candle wick was held with forceps and immersed in the hot oil containing 25% concentration of rice bran wax and quickly removed. The immersed stand alone and votive candles are encased in a new layer of solid containing higher concentration of rice bran wax. These candles show very smooth surface without any discernable layered structure. The encasing technique allows making candles containing different compositions in different layers. This encasing technique is also useful to enhance the dimensional stability and to modify the composition. The encased structure further decreases the loss of volatile components such as fragrances.

Example 13

In this example in addition to the vegetable oil, mineral oil is also employed as base-fuel. Canola oil 31.9 grams is mixed with 10.6 grams of mineral oil containing antioxidant, tocopheryl acetate and a fragrance. To this oil mixture 7.5 grams of rice bran wax is added and heated to melt and form homogeneous liquid oil. The liquid oil, about 13 grams while hot is poured into a tea light container with a wick. About 35 grams of the above liquid oil, while hot and clear is poured into a glass container with a wick to form a votive candle. Both the candles were allowed to cool to form a solid body that occurred in about 12 minutes.

Example 14

Sunflower oil 21.3 grams are mixed with 21.2 grams of mineral oil containing antioxidant and fragrance. Rice bran wax 7.5 grams is added to the oil mixture and heated to 90° C. with stirring to form uniform liquid oil. The liquid oil while hot at about 75° C., a portion of it, about 12 grams is poured into a tea light candle with a wick and another portion of about 35 grams is poured into a votive candle mold containing wick. The tea light candle upon cooling at room temperature transformed into solid in 12 minutes, while the votive candle took a little longer, about 13 minutes.

Example 15

To salad oil (a mixture of soybean oil and canola oil 50/50 wt. %) rice bran wax, 8 wt % of the total is added and homogenized by heating and stirring. The oil wax mixture upon cooling solidified which is subjected to x-ray diffraction. The peaks in the low angle region are very weak while the wide angle region showed sharp peaks at 4.17 Å and 3.75 Å, characteristic to x-ray diffraction pattern of rice bran wax in bulk. The x-ray diffraction pattern also showed a broad hump in the wide angle region which is characteristic to the oil in a liquid state. This example shows the coexistence of rice bran wax crystal net work along with the liquid vegetable oil.

Example 16

Three samples containing three different waxes in olive oil were prepared for morphological observation under a microscope. In each case 1 wt % of each wax, either rice bran wax or carnauba wax or candelilla wax is dissolved in olive oil by melting and stirring. The wax oil mixture is cooled without stirring to form crystals. The crystal morphology of a small sample of each oil wax mixture is observed under a microscope with cross polarized light. The rice bran wax containing sample showed about 50μ long, thin and needle shape crystals. In contrast, the samples containing carnauba wax and candelilla wax showed sperulitic structures of less than 10μ size. The long thin needle shape crystals are conducive to form a crystal network that can hold the large volumes of liquid in a strong solid matrix and provide dimensional stability. Where as the spherulitic crystal structures observed in the case of carnauba wax and candelilla wax, even though can form a crystal network will not be conducive to hold the liquid efficiently and provide the required strength.

The complete disclosures of the patents, patent documents and publications cited herein are incorporated by reference in their entirety as if each were individually incorporated. In case of conflict, the present specification, including definitions, shall control.

Various modifications and alterations to this invention will become apparent to those skilled in the art without departing from the scope and spirit of this invention. Illustrative embodiments and examples are provided as examples only and are not intended to limit the scope of the present invention. The scope of the invention is limited only by the claims set forth as follows.

What is claimed is:

1. A candle comprising one or more layers of a candle composition comprising a mixture of one or more wax-monoesters, and base-fuel, wherein the candle composition comprises a mixture of: 3.0-15% by weight rice bran wax, based on the weight of the mixture, and 85-97% by weight, based on the weight of the mixture, of a vegetable oil which is at least 70% liquid at 25° C., and a wick.

2. The candle of claim 1 wherein the candle composition further comprises up to 20% by weight of the candle composition of at least one additive selected from color, fragrance, mono or di-acyglycerols, organoclays, stabilizers, antioxidants, insect repellents, air-fresheners.

3. A candle comprising a candle composition comprising a mixture of one or more wax-monoesters, and base-fuel, the mixture containing (a) 0.5 to 30 percent, based on the weight of the mixture, linear wax-monoester(s) having a melting temperature of about 70° C. to about 90° C. composed of fatty acids of carbon chain length 16 to 32 esterified to fatty alcohols of carbon chain length 24 to 38, and (b) from 70 to 99.5%, based on the weight of the mixture, of a base-fuel which is at least 70% liquid at 25° C., and a wick.

4. The candle of claim 3 further comprising a cup which is incorporated as part of the final candle.

5. The candle of claim 3, wherein the candle comprises an inner layer of the candle composition which is dip-coated or overlaid with a second layer of the candle composition that has a higher concentration of the linear wax-monoester.

6. The candle of claim 3 which is free-standing.

* * * * *